United States Patent [19]

Brown et al.

[11] Patent Number: 4,491,180

[45] Date of Patent: Jan. 1, 1985

[54] TAPERED STEAM INJECTION PROCESS

[75] Inventors: Alfred Brown, Houston, Tex.; Henry J. Grimm, Allentown, Pa.; Alvin J. Sustek, Jr., Houston, Tex.

[73] Assignee: Texaco Inc., White Plains, N.Y.

[21] Appl. No.: 463,215

[22] Filed: Feb. 2, 1983

[51] Int. Cl.[3] ..... E21B 43/24

[52] U.S. Cl. ..... 166/272

[58] Field of Search ..... 166/272, 303

[56] References Cited

U.S. PATENT DOCUMENTS

| | | | |
|---|---|---|---|
| 3,353,598 | 11/1967 | Smith | 166/272 X |
| 3,360,045 | 12/1967 | Santourian | 166/272 |
| 3,483,924 | 12/1969 | Blevins et al. | 166/272 |
| 3,572,437 | 3/1971 | Marberry et al. | 166/272 |
| 4,060,129 | 11/1977 | Gomaa et al. | 166/272 X |
| 4,093,027 | 6/1978 | Gomaa | 166/272 |

*Primary Examiner*—George A. Suchfield

*Attorney, Agent, or Firm*—Robert A. Kulason; Jack H. Park; Harold J. Delhommer

[57] ABSTRACT

A method is disclosed for recovering hydrocarbons by a series of steps wherein about 0.1 to about 0.6 pore volumes of steam of a relatively high quality is initially injected into the formation. Thereafter, an additional 0.1 to about 0.6 pore volumes of steam is injected wherein the quality of the steam is gradually decreased to a relatively low quality. The injection sequence is concluded with about 0.5 to about 2.0 pore volumes of water, preferably at an ambient temperature.

8 Claims, 1 Drawing Figure

TAPERED STEAM - COLD WATER FLOODS

TAPERED STEAM INJECTION PROCESS

FIELD OF THE INVENTION

This invention is related to copending U.S. patent application Ser. No. 463,203, filed Feb. 2, 1983, and Ser. No. 463,214, filed Feb. 2, 1983. The present invention concerns a steam and water injection oil recovery method. More particularly, the invention pertains to a sequenced method of injecting steam, then steam of decreasing quality followed by water at an ambient temperature.

BACKGROUND OF THE INVENTION

It is well recognized that primary hydrocarbon recovery techniques may recover only a portion of the petroleum in the formation. Thus, numerous secondary and tertiary recovery techniques have been suggested and employed to increase the recovery of hydrocarbons from the formations holding them in place. Thermal recovery techniques have proven to be effective in increasing the amount of oil recovered from the ground. Water flooding and steam flooding have proven to be the most successful oil recovery techniques yet employed in commercial practice, however, the use of these techniques may still leave up to 60% to 70% of the original hydrocarbons in place, depending on the formation and the quality of the oil.

Furthermore, steam flooding can be a very expensive proposition. The oil remaining in a formation may not be worth the high cost of steam injection and production. This is particularly true for light gravity oil reservoirs, especially those which have been previously subjected to water flooding.

The problem in successfully applying steam flooding to light gravity oil reservoirs is associated with process economics and more particularly with incremental oil saturation. In a traditional steam flood application for a heavy oil holding, a change in oil saturation of up to 0.5 and 0.6 are representative oil recovery targets. In conventional and light oil holdings, where water flooding techniques have already been applied, the initial oil saturation value before steam flooding may be as low as 0.3 to 0.4. Even when such as initial oil saturation is reduced to a possible 5% residual oil saturation, a reduction in oil saturation of only 0.25 to 0.35 is obtained. Generally, an incremental recovery goal of 0.25 to 0.35 will not economically support full scale steam flood efforts. Consequently, investigations have been conducted into possible modifications of steam flooding.

It is old in the art to use lower quality steam in a continuous injection manner. A second method is disclosed in U.S. Pat. No. 3,360,045 wherein steam injection is followed by hot water containing a polymer to increase viscosity. A third process is disclosed in U.S. patent application Ser. No. 392,415, filed June 25, 1982, to a varying temperature oil recovery method for heavy oils. In this process, initial injection is begun with ambient temperature water, followed by water of a gradually increasing temperature until 100° C. is reached, followed by steam of a low quality wherein the steam quality gradually increases, followed by a steam flood with high quality steam.

U.S. patent application Ser. No. 463,214, filed concurrently herewith on Feb. 2, 1983, discloses a fourth method for reducing the total quantity of steam injected. This method advocates the use of a small steam slug sufficient to generate a steam distillation front, followed by a slug of non-condensable gas to prevent steam front collapse upon injection of cold water. All of these processes reduce the cost of a usual steam flood and attempt to get oil recoveries similar to that of full-scale steam floods.

SUMMARY OF THE INVENTION

A method is disclosed for recovering hydrocarbons by a series of sequenced steps wherein about 0.1 to about 0.6 pore volumes of steam of a relatively high quality is initially injected into the formation. Thereafter, an additional 0.1 to about 0.6 pore volumes of steam is injected wherein the quality of the steam is gradually decreased from the high quality of the first injection step to a relatively low quality. The low quality steam is then followed by a slug of about 0.5 to about 2.0 pore volumes of water, preferably at an ambient temperature.

DETAILED DESCRIPTION

Figure 1:
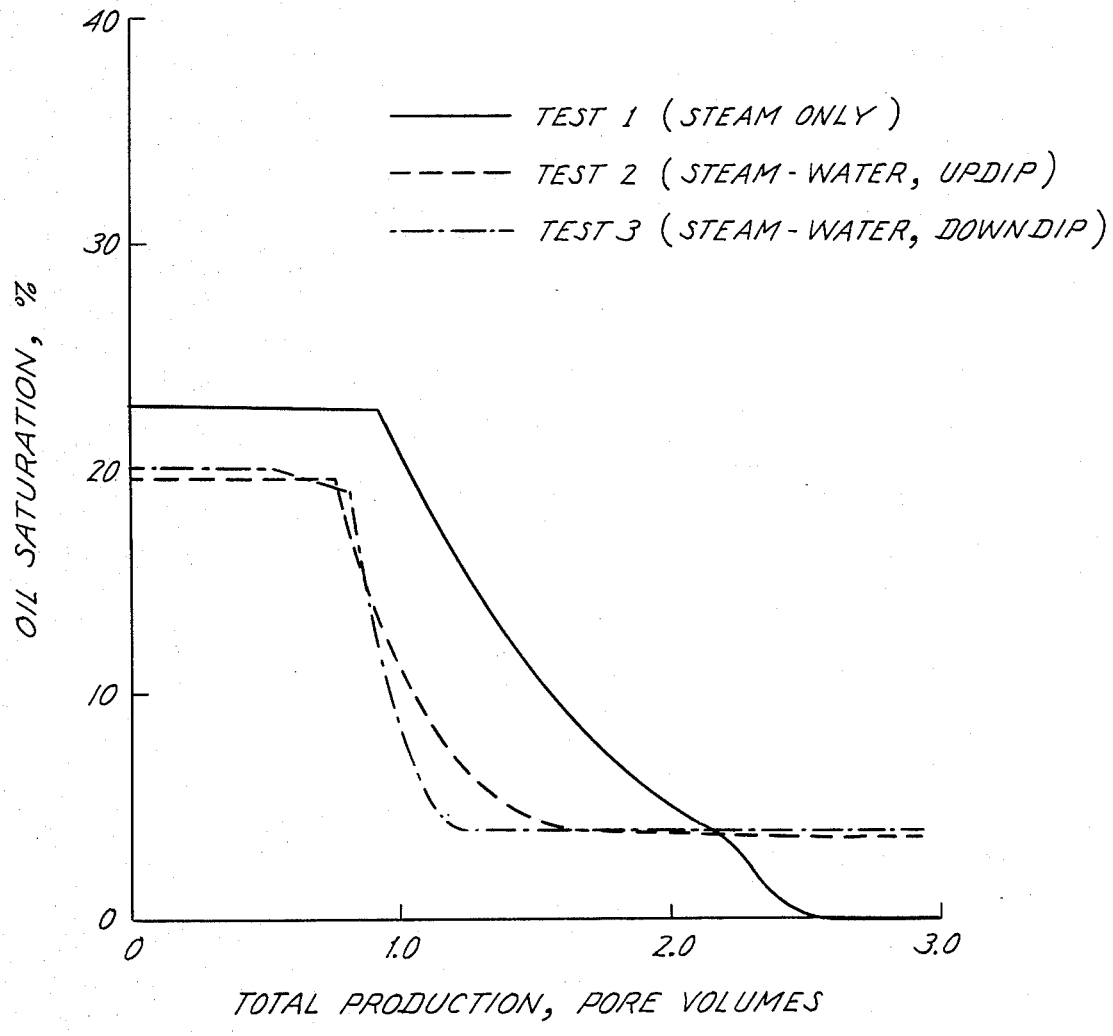
FIG. 1 is a graph illustrating the reduction in oil saturation versus the total production in pore volumes of test examples with the method of the invention.

The present invention provides a method for achieving oil recoveries and residual oil saturations similar to that of a full scale steam flood at only a fraction of the cost of a regular steam flood. This is done by following the injection of a steam slug with the injection of water at ambient temperature. As a result, it is not necessary to inject more than a fraction of the quantity of steam that would normally be injected in a regular steam flood. Test results have shown that similar recoveries can be achieved with only half the amount of steam followed by cold water. This translates into direct cost savings since cold water is much cheaper than high quality steam.

The instant method has a second injection step between the steam and cold water injection steps, wherein steam is injected at a high quality which is gradually tapered to a low quality. Because of this tapered quality steam slug the steam front initially established by the high quality steam injection does not collapse and continues to move through the formation while maintaining the integrity of the in situ distilled solvent bank and driving the hydrocarbons. Because there is no steam front collapse, recovery efficiencies are similar to full scale steam floods even though most of the driving fluid injected is cold water and not expensive steam. When high quality steam is directly followed by cold water in light oil formations, the steam front collapses even at elevated injection pressures and recovery efficiencies are low.

The first step of the injection sequence involves the injection of steam through the injection well at a relatively high quality. Approximately 0.1 to about 0.6 pore volumes, preferably about 0.2 to about 0.5 pore volumes, of steam having a quality of at least 75%, and preferably 100%, is injected into the formation. It is necessary to inject relatively high quality steam in order to establish an efficient steam front to sweep the formation. A smaller quantity of steam is needed for formations containing live oils, those oils which contain dissolved gas. The time required for completion of this steam injection phase will depend upon formation characteristics, pattern size, injection rates and injection pressures.

During the high quality steam injection phase, significant amounts of light crude components will be separated from the bulk of the oil by the mechanism of steam distillation. These steam distilled components will form a condensate bank concentrated immediately in advance of the steam zone. The bank is composed mostly of light end hydrocarbons and builds itself into an in situ generated miscible solvent bank which may occupy as much as about 5% to about 8% of pore volume. A steam distilled condensate bank of this type may approach 100% displacement efficiency.

The second injection step begins immediately after the high quality steam injection step and involves tapering steam quality from the relatively high quality of the first injection step to below 25% steam quality, preferably 0% steam quality. The tapering of the steam quality preferably occurs in a linear fashion over about 0.1 to about 0.6 pore volumes, preferably about 0.2 to about 0.5 pore volumes. This procedure will normally maintain the steam distilled solvent bank integrity and prevent steam front collapse. It has been demonstrated in experimental steam floods that cold water injection too soon causes steam front collapse and back-flow. A properly designed transition phase, wherein the steam quality is gradually lowered to a relatively low quality prevents steam front collapse.

During the gradual transition to lower quality steam, injectivity of the formation and the fluid produced should be constantly monitored to determine if the pressure, quality or quantity of the injected fluid should be modified. If an untenable injectivity loss occurs during the steam transition step or the water injection step, injection should be halted and steam injection resumed. If injectivity problems continue to occur, other restorative measures such as anti-dispersion additives, mud acids or clay stabilizers may be necessary.

Ambient temperature water injection should commence immediately after the steam quality has been reduced to a relatively low quality, preferably about 0%, and should continue until the incremental costs of injection outweigh the incremental value of the produced oil cut. This will normally be within the range of about 0.5 to about 2.0 pore volumes.

Actually, water of any temperature may be injected in the third injection step. Hotter water is generally more effective, but certainly more costly than water at ambient temperature. At any rate, water injected at an ambient temperature will pick up heat as it passes through the steam-heated formation. A viscosity increasing polymer may also be added to the water to be injected to further aid in preventing steam front collapse and to improve sweep efficiency.

It is generally desirable to inject from about 1 to about 3 pore volumes of total fluid into the reservoir. Continuing to increase the quantity of fluid injected until a balance is reached between the amount of fluid injected and the quantity of fluid produced may also be desirable.

The quantity of fluid injected during each step and the decision on when to change from one injection step to another is dependent upon many factors and varies considerably from formation to formation. A few of the factors which must be considered in determining the length of the injection stages are the type of oil in the formation and the manner in which it reacts to steam distillation, the pore volume and porosity of the field, the stability and character of the injection pressure, trends in injection pressure, the vertical conformance of the formation, steam quality, properties of injected fluids and production characteristics including the rate of production from the formation and the temperature response at the production well.

The following examples will further illustrate the tapered steam and cold water injection method of the present invention. These examples are given by way of illustration and not as limitations on the scope of the invention. Thus, it should be understood that the specifics of the various injection stages may be varied to achieve similar results within the scope of the invention.

EXAMPLE 1

A two meter long sand pack was flow saturated with water. The water was displaced by crude oil from a South Texas field having an API gravity of about 45°. The sand pack was then water-flooded to a residual oil saturation of about 23%. The sand pack was rotated to a 60° angle from the horizontal to represent a dipping formation. A back pressure of 250 psig was placed on the sand pack and steam of 100% quality was injected at the updip end.

The initial oil saturation went from 22.9% to about 3.6% after the injection of 1.4 pore volumes of 100% quality steam. This yielded the figures given in Table I for Example 1(a). Steam injection was then continued for another 0.27 pore volumes to reach a total injection of 1.67 pore volumes and approximately a 0% residual oil saturation (Example 1(b)). Table I lists the amount of oil recovered and the ratio of recovered oil to steam injected, a good indication of the cost of such a project.

EXAMPLES 2–3

The same two meter long sand pack was flow saturated with water and 45° API crude from a South Texas field was injected to replace the water. The sand pack was then water-flooded to an approximate oil saturation of 20%, just as in Example 1. At this point, the procedure changed from that of Example 1. However, procedures for Examples 2 and 3 were identical to each other except that injection took place at the updip end of the sand pack in Example 2 and at the downdip end of the sand pack in Example 3.

For the first injection step, a 0.4 pore volume slug of 100% quality steam was injected at the rate of 120 g/hr. During the second injection step, cold water was added at increasing rates to the steam to decrease steam quality in a linear fashion. The steam quality tapered from 100% quality at the beginning of the second injection step to 0% steam quality at the end of the second injection step after 0.45 pore volumes of total fluids. Because the tapering of the steam quality was done in a linear fashion from 100% to 0% steam quality, the total amount of steam injected in the second tapering step was 0.225 pore volumes mixed with cold water to form a total injection of 0.45 pore volumes. Following the tapering steam quality step, cold water was injected alone in the third step at a rate of 480 g/hr. This was done for a total of 2.1 pore volumes. Dean-Stark extractions were performed on the residual oil remaining in the sand pack to give the residual oil saturation.

TABLE I

| Example | Injection of | Injection At | Soi | Sor | Oil Recovered ($cm^3$) | Steam injected ($cm^3$, FWE) | Oil-Steam Ratio ($cm^3/cm^3$) |
|---|---|---|---|---|---|---|---|
| 1(a) | Steam Only | Updip | 0.229 | 0.036 | 595 | 4380 | 0.14 |
| (b) | | | 0.229 | 0.0 | 707 | 5152 | 0.14 |
| 2 | Steam Water | Updip | 0.193 | 0.035 | 486 | 1923 | 0.25 |
| 3 | Steam Water | Down dip | 0.200 | 0.039 | 499 | 1923 | 0.26 |

What is claimed is:

1. A method for stimulating the production of hydrocarbons from a subterranean hydrocarbon-bearing formation penetrated by an injection well and a production well, wherein the injection procedure comprises:

(a) injecting about 0.1 to about 0.6 pore volumes of steam of a relatively high quality into the formation;

(b) after injection of the relatively high quality steam, injecting into the formation about 0.1 to about 0.6 pore volumes of steam while gradually decreasing the quality of the steam from a relatively high quality to a relatively low quality of steam; and (c) after injection of the decreasing quality steam, injecting about 0.5 to about 2.0 pore volumes of water into the formation.

2. The method of claim 1, wherein the injected steam has a quality of at least 75%.

3. The method of claim 1, wherein the quality of the steam is gradually decreased in an essentially linear manner to below 25%.

4. The method of claim 1, wherein the formation has been subjected to water flooding prior to the injection of steam.

5. The method of claim 1, wherein the water is injected into the formation at ambient temperature.

6. The method of claim 1, wherein a polymer is added to the water to be injected to increase the viscosity of the water.

7. The method of claim 1, wherein the steam and water are injected into the formation at the highest permissible rate without fracturing the formation.

8. A method for stimulating the production of hydrocarbons from a subterranean hydrocarbon-bearing formation penetrated by an injection well and a production well, wherein the injection procedure comprises:

(a) injecting about 0.2 to about 0.5 pore volumes of steam having a quality of at least 75% into the formation;

(b) after injection of at least 75% quality steam, injecting into the formation about 0.2 to about 0.5 pore volumes of steam having a steam quality which decreases linearly from the steam quality of the first injection step to a steam quality of about 0%; and (c) after injection of the decreasing quality steam, injecting about 0.5 to about 2.0 pore volumes of water at ambient temperature into the formation.

* * * * *

UNITED STATES PATENT AND TRADEMARK OFFICE

CERTIFICATE OF CORRECTION

PATENT NO. : 4,491,180

DATED : January 1, 1985

INVENTOR(S) : Alfred Brown, Henry J. Grimm and Alvin J. Sustek

It is certified that error appears in the above-identified patent and that said Letters Patent is hereby corrected as shown below:

Claim 2 which now reads "The method of claim 1, wherein the injected steam has a quality of at least 75%" should read --The method of Claim 1, wherein the injected steam of a relatively high quality has a quality of at least 75%--.

Signed and Sealed this

*Twenty-third* Day of *April 1985*

[SEAL]

*Attest:*

DONALD J. QUIGG

*Attesting Officer*

*Acting Commissioner of Patents and Trademarks*